US012292186B2

(12) United States Patent
Pieper

(10) Patent No.: US 12,292,186 B2
(45) Date of Patent: May 6, 2025

(54) ASSEMBLY COMPRISING A STEAM SATURATOR AND METHOD FOR OPERATING AN ASSEMBLY OF THIS TYPE

(71) Applicants: thyssenkrupp Industrial Solutions AG, Essen (DE); thyssenkrupp AG, Essen (DE)

(72) Inventor: Matthias Pieper, Unna (DE)

(73) Assignees: thyssenkrupp Uhde GmbH, Dortmund (DE); thyssenkrupp AG, Essen (DE)

( * ) Notice: Subject to any disclaimer, the term of this patent is extended or adjusted under 35 U.S.C. 154(b) by 362 days.

(21) Appl. No.: 17/793,105

(22) PCT Filed: Jan. 13, 2021

(86) PCT No.: PCT/EP2021/050596
§ 371 (c)(1),
(2) Date: Jul. 15, 2022

(87) PCT Pub. No.: WO2021/148287
PCT Pub. Date: Jul. 29, 2021

(65) Prior Publication Data

US 2023/0043988 A1 Feb. 9, 2023

(30) Foreign Application Priority Data

Jan. 22, 2020 (DE) ..... 10 2020 200 720.9

(51) Int. Cl.
*F01K 17/06* (2006.01)
*F22B 1/14* (2006.01)

(52) U.S. Cl.
CPC ..... *F22B 1/14* (2013.01)

(58) Field of Classification Search
CPC ..... F22B 37/00; F22B 37/261; F22B 37/265; F22B 1/14; F16K 24/00; F24H 1/00;
(Continued)

(56) References Cited

U.S. PATENT DOCUMENTS 3,787,559 A 1/1974 Rudolph et al.
5,038,611 A 8/1991 Weldon et al.
9,500,513 B2 * 11/2016 Liu ..... G01F 23/162

FOREIGN PATENT DOCUMENTS

DE 20 46 753 A1 4/1972
DE 27 18 927 A1 11/1978
(Continued)

OTHER PUBLICATIONS

English Translation of International Search Report Issued in PCT/EP2021/050596 dated Apr. 1, 2021.

*Primary Examiner* — Gregory A Wilson
(74) *Attorney, Agent, or Firm* — thyssenkrupp North America, LLC

(57) ABSTRACT

An arrangement includes a steam saturator for producing saturated steam and a device for refeeding the liquid evaporated in the steam saturator. The steam saturator includes a steam inlet via which steam is delivered to the steam saturator, a steam outlet for the saturated steam produced, a condensate inlet via which condensate is delivered to the steam saturator, and a condensate return line. In a lower region of the steam saturator, a condensate liquid level that is fluidically connected to the condensate return line is maintained. The condensate return line is connected to the device, which is a condenser and comprises a cooling apparatus for condensing steam. In the steam saturator, the evaporated liquid is replaced only if the condensate level in the steam saturator drops, through condensation of saturated steam delivered from the steam saturator to the condenser and is then condensed in the condenser by the cooling apparatus.

18 Claims, 4 Drawing Sheets

(58) Field of Classification Search
CPC ... F01K 1/00; F01K 11/00; F01K 3/14; F01K 9/003; F01K 17/06; F01K 17/00
See application file for complete search history.

(56) References Cited

FOREIGN PATENT DOCUMENTS

| | | | |
|---|---|---|---|
| DE | 35 18 174 | A1 | 12/1986 |
| DE | 10 2008 064 252 | A1 | 6/2010 |
| EP | 1 300 630 | A1 | 4/2003 |
| WO | WO-2019204339 | A1 * | 10/2019 |

* cited by examiner

ASSEMBLY COMPRISING A STEAM SATURATOR AND METHOD FOR OPERATING AN ASSEMBLY OF THIS TYPE

CROSS REFERENCE TO RELATED APPLICATIONS

This application is a U.S. National Stage Entry of International Patent Application Serial Number PCT/EP2021/050596, filed Jan. 13, 2021, which claims priority to German Patent Application No. DE 10 2020 200 720.9, filed Jan. 22, 2020, the entire contents of which are incorporated herein by reference.

FIELD

The present disclosure generally relates steam saturators, including assemblies that include a steam saturator and methods for operating such assemblies.

BACKGROUND

Saturated steam is used in many processes since, in comparison with superheated steam, it has two advantages: Firstly, the temperature is directly linked to the pressure, so that, via pressure regulation, it is also possible for the temperature to be regulated very well. Secondly, saturated steam is better suited to heating other fluids in heat exchangers since, upon contact with cooler surfaces, immediate condensation with high heat-transfer coefficients is possible. In the case of superheated steam, by contrast, cooling to the saturation temperature with lower coefficients is firstly necessary before the condensation starts.

Saturated steam is either prepared directly in steam generators or is produced from superheated steam in steam saturators. Since, however, there are also applications for superheated steam and the transport of superheated steam offers advantages, it is normally the case that a steam saturator is used only where saturated steam is actually required.

A steam saturator generally consists of a pressure vessel which is partly filled with liquid (steam condensate or boiler feed water). The vessel may be of vertical or horizontal design. Situated below the liquid level is a steam distributor through which the superheated steam is introduced into the liquid. A means for maintaining pressure ensures that sufficient quantities of superheated steam are refed, in order for the desired process pressure on the saturated-steam side to be maintained. Since the steam that is fed in has to flow at a defined pressure through the liquid, it re-emerges at the liquid surface as saturated steam at precisely this pressure and can be withdrawn from the pressure vessel and directed to the consumers.

As long as the steam saturator is operated with a sufficiently high liquid level, production of saturated steam is ensured. The steam saturator may be equipped in a relatively simple manner with safety devices for overtemperature and overpressure and also for excessively high and excessively low fill levels.

Since, however, due to the introduction of superheated steam, a part of the liquid contained in the steam saturator evaporates, a reduction in the fill level occurs. This liquid must be refed in order to be able to maintain the intended operation of the steam saturator and to protect downstream systems from excessively high steam temperature. This is particularly relevant in applications in which excessively high steam temperatures can damage a product or pose safety risks, such as for example in the case of ammonium nitrate.

Refeeding has hitherto been realized in two different ways: In the case of steam saturators which provide a supply to only one consumer, for example the concentrator of an ammonium-nitrate plant, the condensate of the consumer may be delivered directly back into the steam saturator. The steam saturator then has a discharge and/or an overflow by way of which the surplus condensate can exit the steam saturator/consumer system again. The alternative to date consists of a condensate line which replenishes the steam saturator either via an external pressure line with steam condensate or boiler feed water or via plant-internal returning of steam condensate via the steam condensate pumps.

Refeeding by way of an external source (for example a boiler-feed-water pressure line) requires the presence of precisely this line and an external pressure source, and in addition also an automatic valve for control of the fill level in the steam saturator. In the case of supply of steam condensate from plant-internal pumps, it is necessary for said pumps to be in operation and to apply the delivery pressure necessary in order for delivery into the pressurized steam saturator to be possible. Procurement and operation of said pumps are thus made more expensive—for small quantities of steam condensate that has to be conducted backed into the steam saturator. Here, too, use has to be made of an automatic valve.

DE 27 18 927 A1 has disclosed a steam saturator for textile-finishing apparatuses, wherein the steam saturator here is in the form of a vertical vessel and has a conical base part in which the water not absorbed by the steam accumulates. In order to obtain a constant bath surface in said conical base part, a line with a float drain opens out into the lower part of the vessel. The respective bath-surface level can be read at a water-level indicator. Surplus water can be withdrawn via a drain valve at the lowest point of the vessel. The surplus water can be delivered via a line to a pump and can be subsequently circulated via valves and thereby conducted back into the vessel.

DE 2046753 A1 has disclosed a method and a plant for desulfurization of hot pressurized gases. An $H_2S$— and water-vapor-containing gas is cooled and passed through an absorption tower in which $H_2S$ is washed out, and then flows to a steam saturator in which it is heated via a liquid heated in a cooler and is saturated with steam. For the saturation, use is made of circulation water which is plant-provided condensate from two coolers. The plant-provided condensate is partially removed, and the quantity of water needed as a supplement for the circuit is partially extracted via a line, delivered to a stripper and then fed into the steam saturator via a circulation line in the upper region. Here, the water from the circuit is evaporated in the steam saturator into the clean gas. In the case of this known plant, there is no correlation between a fill level of the steam condensate in the steam saturator and the liquid level in the coolers. Here, too, measurement and control devices are necessary to determine what volume of condensate is needed to supplement the quantity of water required for the refeeding. Moreover, the plant used here is of fairly complex construction.

Thus a need exists for an arrangement with a steam saturator where refeeding of condensate evaporated in a steam evaporator is realized automatically, as it were.

DETAILED DESCRIPTION

Figure 1:
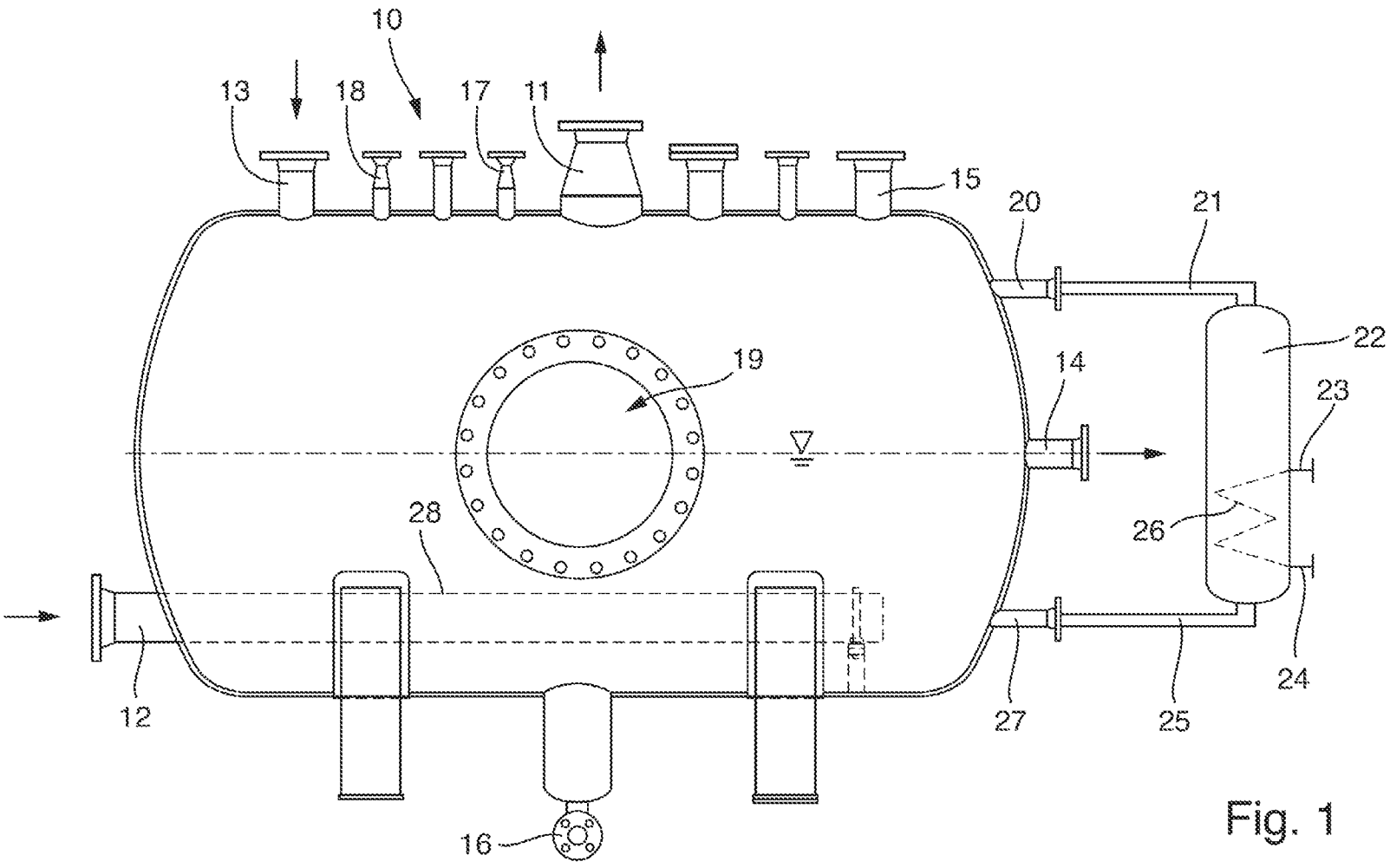
FIG. 1 is a schematically simplified view of an example arrangement with steam saturator and condenser.

Although certain example methods and apparatus have been described herein, the scope of coverage of this patent is not limited thereto. On the contrary, this patent covers all methods, apparatus, and articles of manufacture fairly falling within the scope of the appended claims either literally or under the doctrine of equivalents. Moreover, those having ordinary skill in the art will understand that reciting "a" element or "an" element in the appended claims does not restrict those claims to articles, apparatuses, systems, methods, or the like having only one of that element, even where other elements in the same claim or different claims are preceded by "at least one" or similar language. Similarly, it should be understood that the steps of any method claims need not necessarily be performed in the order in which they are recited, unless so required by the context of the claims. In addition, all references to one skilled in the art shall be understood to refer to one having ordinary skill in the art.

In some examples of the present disclosure, an arrangement may include a steam saturator for producing saturated steam and a device for refeeding the liquid evaporated in the steam saturator. The steam saturator comprises a steam inlet via which steam is delivered to the steam saturator, a steam outlet for the saturated steam produced, and a condensate return line. In the lower region of the steam saturator, a condensate liquid level that is fluidically connected to the condensate return line is maintained. The condensate return line is connected to the device for refeeding the evaporated liquid.

According to the invention, the device for refeeding the condensate is in the form of a condenser and comprises a cooling apparatus for condensing steam delivered to said device.

The solution according to the invention makes provision for the steam saturator to be extended by a condenser operated with a coolant, for example with cooling water. This coolant-operated condenser may preferably have relatively small dimensions in comparison with the volume and the size of the steam saturator to which the condenser is assigned. Said condenser is preferably dimensioned and arranged in such a way that it produces from saturated steam merely the quantity of steam condensate that is required for refeeding. Although, for this purpose, a secondary medium, in particular cooling water, is required. This is available in plants of this type anyway and is already monitored in respect of the throughflow. Therefore, no outlay for additional measurement and control technology arises.

Hence, the solution according to the invention takes a different approach than the aforementioned prior art. The evaporated condensate is not delivered as circulating liquid, that is to say circulation water, to the steam saturator, but rather the condensate is produced in the condenser only according to requirement, in effect, specifically if the condensate level in the steam saturator drops, specifically through condensation of saturated steam which is delivered from the steam saturator to the condenser and is then condensed in the condenser by means of the cooling apparatus.

Preferably, according to a refinement of the invention, the arrangement comprises at least one connecting line for saturated steam leading from the steam saturator to the condenser, which is provided for conveying saturated steam from the steam saturator into the condenser. Via said connecting line, the steam for the formation of condensate for the refilling (refeeding) of the steam saturator is delivered to the condenser, so that an additional steam source is not necessary.

According to a preferred refinement of the invention, in addition to a first steam outlet for saturated steam, the steam saturator comprises at least one second steam outlet, which is fluidically connected to the condenser via a connecting line. Via the stated first steam outlet, the saturated steam produced in the steam saturator is removed and is then delivered to the corresponding consumption points that require saturated steam. The second steam outlet is connected via the connecting line to the condenser and feeds the latter with saturated steam required for producing condensate for the refeeding.

According to a preferred refinement of the present invention, the steam saturator has at least one condensate return line which is fluidically connected to the lower region of the condenser via at least one connecting line. If, according to requirement, condensate for the steam saturator is produced in the condenser, said condensate can flow from the condenser to the steam saturator via the connecting line and the condensate return line. Preferably, said condensate return line is situated in a lower region of the steam saturator. Moreover, in addition to the condensate return line, the steam saturator preferably has, at a point which, as seen in the height direction of the steam saturator, is situated above the condensate return line, a regular condensate outlet via which, for example in the case of an excessively high level in the steam saturator, condensate can be removed from the steam saturator.

Preferably, according to one refinement of the present invention, the steam saturator is coupled to the condenser via the connecting lines in the manner of communicating tubes in such a way that, if the condensate liquid level in the steam saturator changes, the condensate liquid level in the condenser changes in a corresponding manner. By way of this measure, a drop in the condensate level in the steam saturator necessarily also leads to a drop in the level in the condenser, whereby, in the condenser, the steam-condensation process is triggered automatically, as it were, when, in the steam saturator, the need for additional condensate has arisen.

Preferably, according to a refinement of the present invention, the cooling apparatus of the condenser has heat-transfer surfaces which, with a normal fill level in the steam saturator, are flooded with condensate. Consequently, as long as this normal fill level prevails in the steam saturator, no additional condensate is produced in the condenser. However, if the fill level in the steam saturator drops, the level in the condenser necessarily also drops and the aforementioned heat-transfer surfaces of the cooling apparatus are then partly exposed and condense saturated steam in the condenser that is delivered thereto from the steam saturator. The condensate liquid level in the steam saturator then rises again.

Hence, the attachment of the condenser outside the steam saturator has the advantage that cooling of steam condensate is not continuous. However, within the context of the present invention, the condenser may be arranged alternatively both within and outside the steam saturator. If arranged within the steam saturator, said condenser does not necessarily need to have its own housing.

A preferred refinement of the present invention provides that the size and the volume of the condenser are less than half of the vessel size and the vessel volume of the steam saturator, preferably less than one third, particularly preferably only a fraction, for example only one fifth or only one tenth. In particular, if the condenser is arranged outside the steam saturator and has its own housing, there is a cost advantage if the condenser is smaller than the steam saturator, preferably considerably smaller than it. The condenser may be connected for example via two flange connections to the steam saturator itself. One of these flange connections is situated in the region of a second steam outlet of the steam saturator, from which steam flows from the steam saturator to the condenser via at least one connecting line. The second of these flange connections is situated in the region of the condensate return line, via which condensate produced in the condenser flows to the steam saturator in order for condensate to be refed.

For a condenser situated outside the housing of the steam saturator, firstly, it is possible for use to be made for example of an inexpensive standard component, and moreover, it is also the case that only a relatively small heat-transfer area is required. The condenser can thus be of relatively small construction in comparison with the size of the steam saturator, since the condenser has to produce condensate only if the liquid level in the steam saturator drops, that is to say the condenser has to replace only that proportion of liquid which has evaporated in the steam saturator. An example here is an ammonium-nitrate plant with a capacity of for example 1500 t/day. In such a plant, the condenser would have for example a power of approximately 20 kW which would have to be dissipated into the cooling water.

The condenser may, for example, be specified and ordered together with the steam saturator by the user, which reduces the administration costs.

According to a preferred refinement of the present invention, the cooling apparatus of the condenser has a cooling-medium inlet and a cooling-medium outlet, wherein the cooling-medium inlet is preferably fed by an externally delivered cooling medium which is not the condensate which accumulates in the steam saturator. In the case of the solution known from DE 2 046 753 A1, condensate is removed as circulation water from the steam saturator and used as cooling water in a cooler, where it is then heated and the heated water is mixed with condensate from the cooler and delivered as circulation water to the steam saturator again. Consequently, what is involved here is process condensate combined with condensate from the steam saturator which is used for replenishing the steam saturator. In the case of the solution according to the invention, by contrast, preferably only a small portion of the saturated steam produced in the steam saturator is delivered to the cooling apparatus in the condenser and, there, condensed, using a consequently likewise relatively small amount of a coolant and also only according to requirement, and delivered via the condensate return line to the steam saturator, in order to keep the liquid level constant there.

According to a preferred refinement of the present invention, the steam saturator comprises a horizontal or a vertical pressure vessel, within which a steam distributor is arranged in the lower region below the liquid level. In principle, the present invention comes into consideration, however, both for steam saturators with a vertical pressure vessel and for those with a horizontal pressure vessel. In both variants, use is preferably made of a steam distributor which is situated below the liquid level in the steam saturator and thus introduces the superheated steam into the liquid (condensate), so that, after exiting the liquid, saturated steam is obtained.

Preferably, said steam distributor is in the form of a tube which has numerous holes for the exiting of steam and which is connected at one end region thereof to the steam inlet of the steam saturator.

A significant further advantage of the solution according to the invention is that an external water source (including the pipeline, required therefor, on the pipe bridge and an automatic valve) can be saved. The condenser of the steam saturator may be operated with a medium which, anyway, is available for the plant and is monitored. This results not only in possibilities for saving when the components are purchased, but also reductions concerning engineering, assembly and commissioning of the systems. Plant availability increases, while the outlay for operation (for example energy for pressure generation and delivery to the steam saturator), maintenance and testing is reduced.

The subject matter of the present invention furthermore comprises a method for operating an arrangement comprising a steam saturator and a device for refeeding the liquid evaporated in the steam saturator, in particular for operating an arrangement having the above-described features, wherein saturated steam is produced in the steam saturator in that superheated steam (or saturated steam of a relatively high pressure and temperature level) is delivered to the steam saturator, said superheated steam being introduced via a steam distributor into a condensate liquid volume present in the lower region of the steam saturator, wherein a condensate liquid level in the steam saturator is maintained in that, if the liquid level drops, condensate is refed via the device for refeeding, which is connected to the steam saturator, wherein, according to the invention, steam is delivered from the steam saturator to the device for refeeding, said steam is condensed in the device for refeeding in a cooling apparatus, and the device for refeeding is coupled via a connecting line for condensate to the steam saturator in such a way that, if the liquid level in the steam saturator drops, the liquid level in the device for refeeding also drops, steam is thereby condensed in the device automatically and this condensate is delivered to the steam saturator.

According to a preferred refinement of the method, with a normal fill level in the steam saturator, heat-transfer surfaces of the cooling apparatus in the device for refeeding are flooded with steam condensate. In this state, no steam is condensed in the condenser. If, however, the fill level in the steam saturator drops below the normal fill level, heat-transfer surfaces of the cooling apparatus in the device for refeeding are partly exposed, since there, owing to the principle of communicating tubes, the condensate liquid level also drops, thereby, the steam condenses at these then exposed cooler heat-transfer surfaces and steam is condensed in the device. The condensate formed in this way in turn flows, owing to the principle of communicating tubes, into the lower region of the steam saturator, so that the liquid level rises there. This process may proceed in an alternating and continuously repeating manner, whereby the liquid in the steam saturator is always replenished by condensate produced in the condenser.

According to a preferred refinement of the method, condensate accumulating in the device for refeeding evaporated liquid flows from the device into the steam saturator in a pressureless manner and without a separate conveying device. This is advantageous in comparison with known plant concepts, in the case of which, for the refeeding, provision must be made of pressure lines, an external pressure source, automatic valves for controlling the fill level in the steam saturator and plant-internal pumps in order for the required delivery pressure to be applied in order for delivery into the pressurized steam saturator to be possible.

Reference is made below to FIG. 1, and, on the basis of this, an exemplary embodiment variant of the arrangement according to the invention will be discussed in more detail. The illustration as per FIG. 1 is schematically highly simplified, and only those plant components which are relevant within the context of the present invention are illustrated. The arrangement comprises a steam saturator, which is denoted as a whole by the reference sign 10. The steam saturator 10 is a pressure vessel, specifically in the exemplary embodiment a horizontal pressure vessel, that is to say the axis of the approximately cylindrical pressure vessel extends substantially horizontally. The steam saturator 10 according to the invention serves for producing saturated steam, for which purpose a liquid level of condensate is present in the steam saturator up to a particular fill level, wherein this condensate in turn can be recovered through condensation of steam. Superheated steam (or saturated steam at a relatively high pressure level and temperature level) is passed through said condensate and is thereby saturated with liquid (water), so that saturated steam is produced. The delivered steam is introduced into the pressure vessel 10 via a steam inlet 12 in the lower region and passes into a tubular steam distributor 28, said steam distributor having numerous holes through which the steam exits, is introduced into the liquid, is passed through the liquid and exits the latter as saturated steam. Via the steam outlet 11 arranged in the upper region of the pressure vessel, the saturated steam can be discharged and delivered to a further application.

The steam saturator 10 furthermore comprises a condensate inlet 13, which is arranged for example in an upper region and via which condensate can be delivered to the steam saturator 10. The steam saturator 10 moreover comprises a condensate outlet 14, which can be arranged for example in a lateral region of the pressure vessel at a central height, preferably at a height which corresponds to the intended maximum liquid level of the condensate in the steam saturator 10, so that, if this liquid level is exceeded, surplus condensate can exit the pressure vessel via the condensate outlet 14.

The pressure vessel of the steam saturator 10 has, for example in a lower central region, a drain 16 via which the steam saturator can be emptied and desludged. Moreover, provision is made of a filling line 17 in an upper or, alternatively, in a lower region of the pressure vessel, via which filling line the steam saturator can be filled with water/condensate. Moreover, provision is also made of a connection 15 for a safety valve on the pressure vessel in the upper region, so that, where applicable, in the event of an overpressure, steam can be discharged, upon response of the safety valve, via said connection 15. Furthermore, provision is also made on the pressure vessel, preferably in an upper region, of a connection for a venting line 18. The pressure vessel has a manhole 19, for example in a lateral region, such that it is possible via the manhole to walk over the vessel for maintenance and cleaning purposes. Finally, the pressure vessel may have, for example in the upper region, further connections, which are provided in reserve, as it were, for example in order for further units to be connected. For the sake of better clarity, connections for measuring devices (for example for pressure, temperature, fill level) have not been illustrated.

In a lower end-side region, a condensate return line 27 is arranged on the pressure vessel, wherein the condensate return line 27 may be attached for example laterally too. Said condensate return line 27 is connected via a connecting line 25 to a condenser 22, which condenser, in this exemplary embodiment, is arranged outside the steam saturator and has its own housing. As can be seen from the drawing, the condenser 22 is of considerably smaller size than the steam saturator 10, wherein it is generally the case that a fraction of the size of the steam saturator 10 suffices. Said condenser 22 serves as a device for refeeding the liquid evaporated in the steam separator by the steam-saturation process. Since steam superheated via the steam distributor 28 is introduced into the liquid present in the lower region of the steam saturator, a part of said liquid evaporates and consequently has to be refed. However, in comparison with the total volume of the liquid in the steam saturator 10, it is only ever the case that a relatively small proportion evaporates, so that a small condenser 22 is sufficient for the refeeding. The condensate produced in the condenser 22 passes via the condensate return line 27 into the lower region of the steam saturator 10 and ensures that a sufficient liquid level is always maintained in the steam saturator. This refeeding process is realized, in the case of the arrangement according to the invention, practically automatically and will be discussed in more detail below.

The steam saturator 10 comprises a second steam outlet 20 in the upper region, to which there is connected a connecting line 21 leading to the condenser 22, so that steam can pass from the steam saturator 10 into the condenser 22 via said connecting line 21. A cooling apparatus 26 with heat-exchange surfaces (illustrated merely in a schematically simplified manner in FIG. 1) is situated in the condenser 22. Normally, said heat-exchange surfaces are flooded with condensate, so that no additional condensate is produced in the condenser 22. As has already been mentioned, the steam saturator 10 and the condenser 22 are connected to one another in the lower region via the connecting line 25 and the condensate return line 27. Since the condensate return line 27 at the steam saturator 10 is situated at a height at which liquid is present in the steam saturator, the connection via the connecting line 25 functions according to the principle of communicating tubes. If the liquid level in the steam saturator 10 drops, this also correspondingly drops in the condenser 22. This results in the previously flooded heat-exchange surfaces of the cooling apparatus 26 then being partly exposed. Through the cooling apparatus 26, for example a coolant loop, a coolant is passed, for example cooling water, which flows in via the cooling-water inlet 23 and exits again via the cooling-water outlet 24. Here, use may be made of a coolant which is available in the plant. Since the cooling apparatus 26 is of relatively small construction, a relatively small volume flow of coolant suffices for the feeding of the cooling apparatus 26. If, then, the heat-exchange surfaces are partly exposed through the dropping of the liquid level in the condenser 22, this results in steam condensing on these relatively cool heat-exchange surfaces, whereby condensate is formed and the liquid level in the condenser 22 consequently rises again until the heat-exchange surfaces of the cooling apparatus are again flooded by condensate. Since the condenser 22 and the steam saturator 10 are connected to one another via the connecting line 25 and the condensate return line 27 in the manner of communicating tubes, as a result of the condensate formation in the condenser 22, the liquid level in the steam generator 10 also rises again. Consequently, formation and refeeding to the steam saturator of condensate which the steam saturator needs to maintain its liquid level is realized only temporarily.

Figure 2:
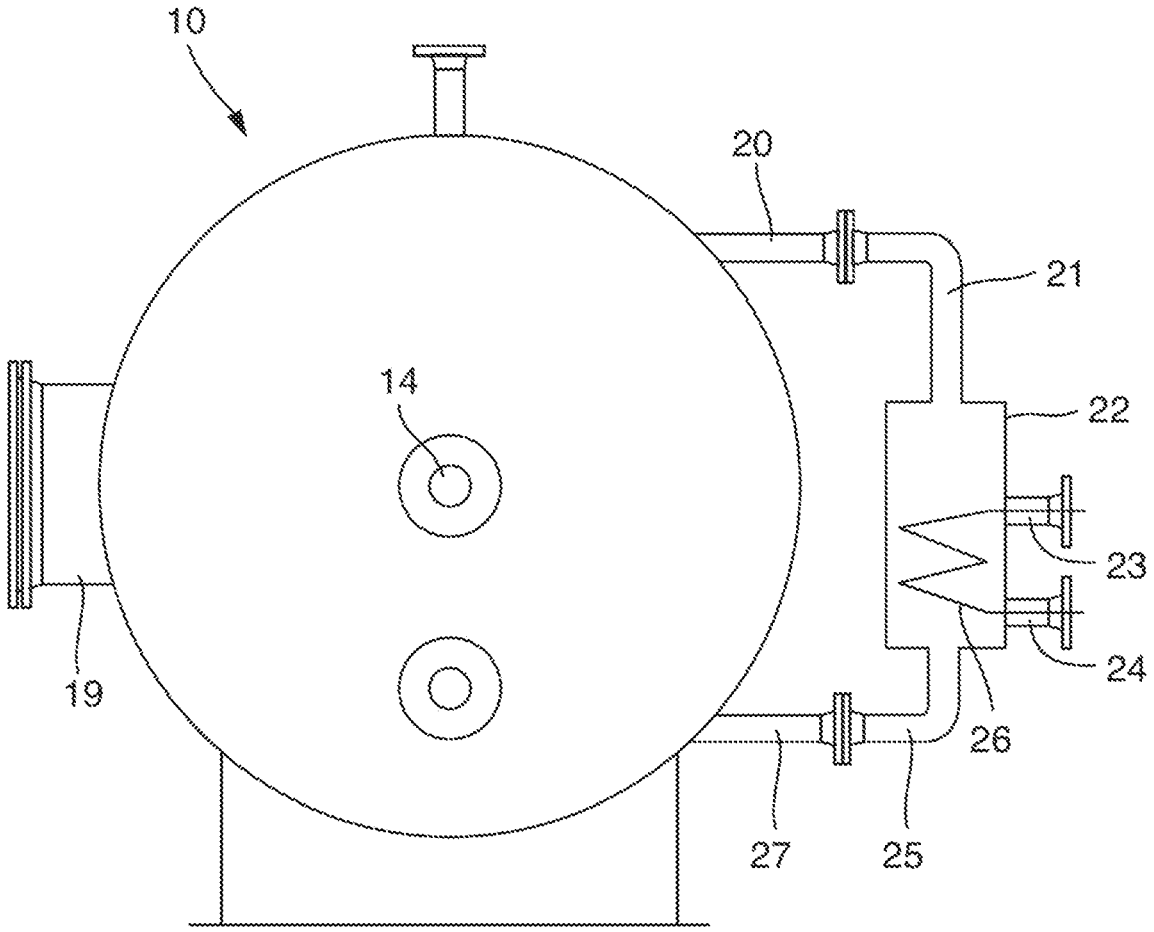
FIG. 2 is an end-side view of the arrangement with steam saturator and condenser as per FIG. 1.

FIG. 2 shows the steam saturator 10 as viewed from an end side, and the second steam outlet 20 in the upper region for the delivery of steam from the steam saturator 10 to the condenser and the condensate return line 27 in the lower region of the steam saturator for the refeeding of condensate from the condenser 22 to the steam generator can be seen here. Furthermore, the coolant loop 26 of the condenser 22, which is fed via the cooling-water inlet 23, can be seen. The illustration is schematic and the heat-exchange surfaces are merely indicated.

Figure 3:
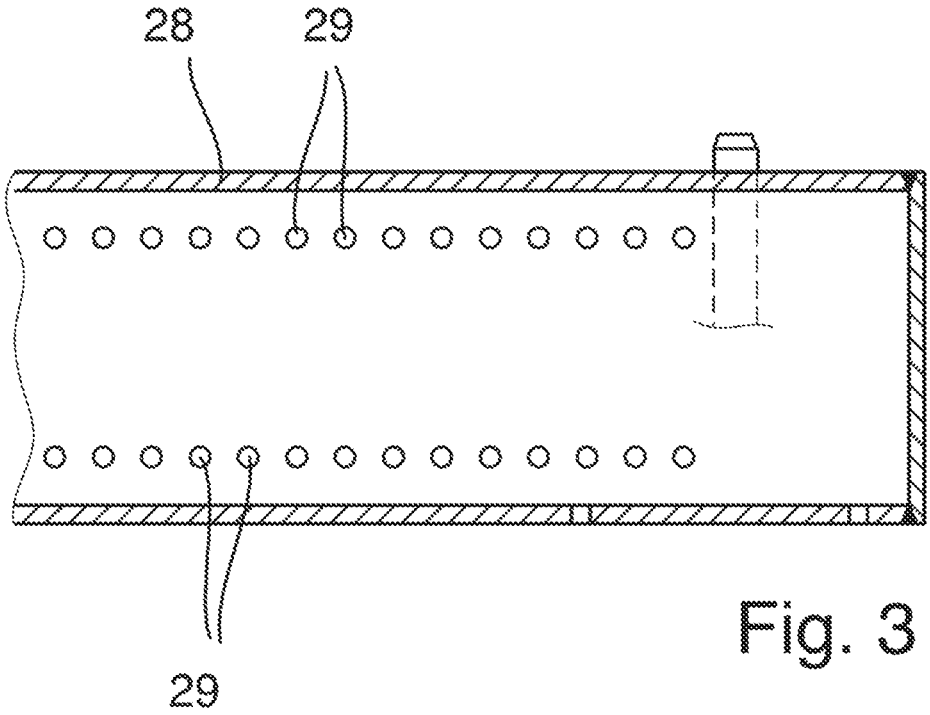
FIG. 3 is an enlarged schematic view of a detail from FIG. 1 concerning the steam distributor arranged in the steam saturator.
Figure 4:
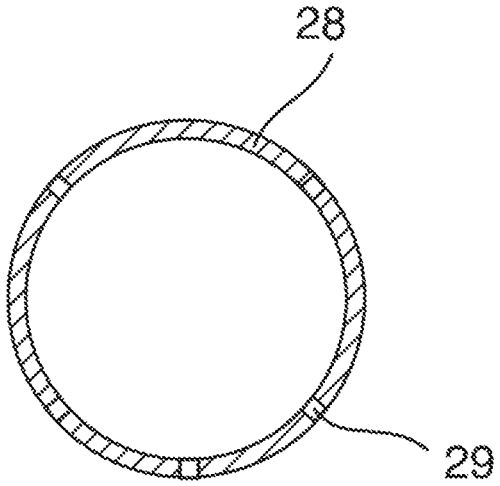
FIG. 4 is a sectional view through the steam distributor in FIG. 3.
Figure 5:
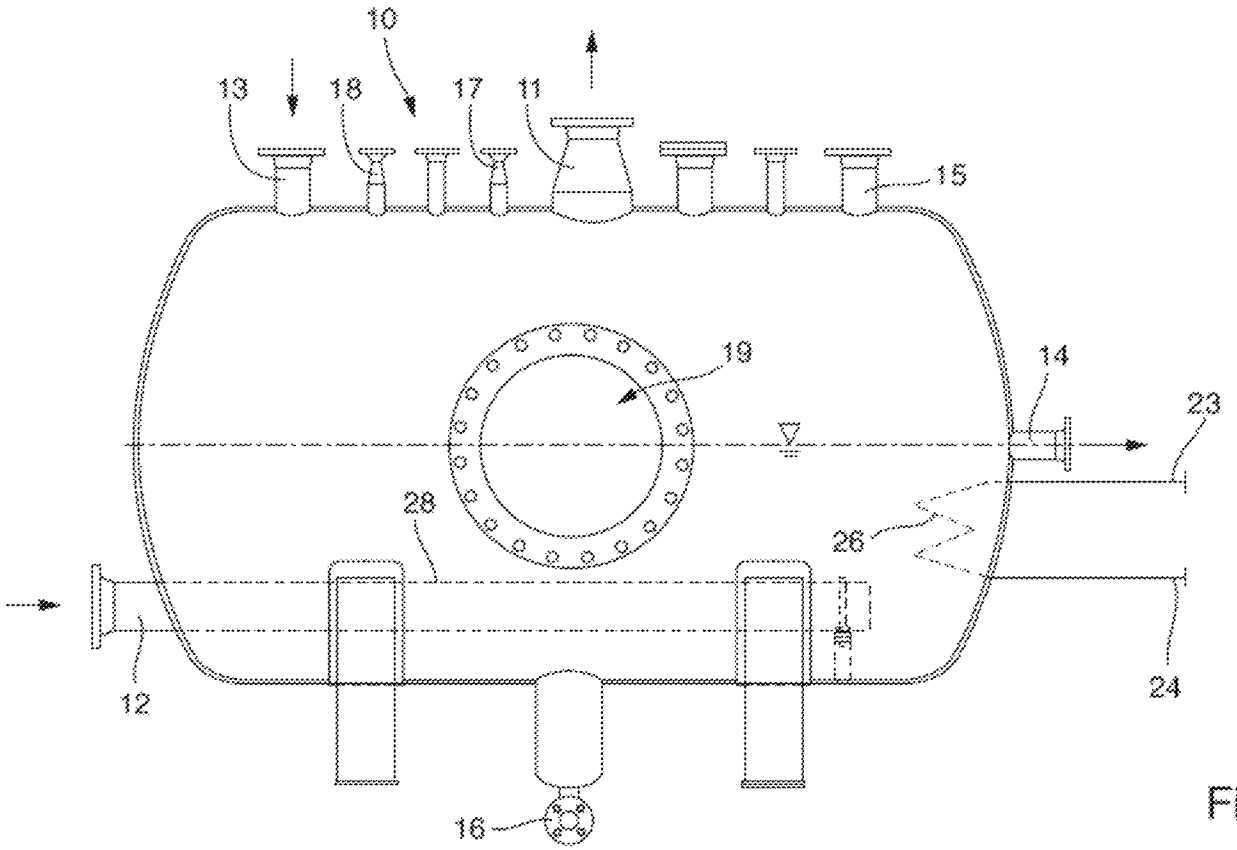
FIG. 5 is a schematically simplified view of an example arrangement with steam saturator and condenser in which the condenser is disposed within a housing of the steam saturator.

FIGS. 3 and 4 show a detail from the interior of the steam saturator 10 in an enlarged illustration. Here, FIG. 3 illustrates a portion of the steam distributor 28, said steam distributor being a cylindrical tube which has numerous holes 29 and which is situated in the steam saturator in the lower region, specifically below the liquid level. When superheated steam flows into the tube of the steam distributor 28 via the steam inlet 12, said steam exits the tube via the holes 29 and flows through the liquid, whereby saturated steam is formed, which saturated steam can be removed from the steam saturator via the steam outlet 11 (see also FIG. 1). FIG. 4 shows a cross section through the tube of the steam distributor 28, said tube for example being of cylindrical form and having numerous holes 29 for the exiting of steam.

LIST OF REFERENCE SIGNS

10 Steam saturator
11 Steam outlet
12 Steam inlet
13 Condensate inlet
14 Condensate outlet
15 Connection for safety valve
16 Drain for emptying
17 Filling line
18 Venting line
19 Manhole
20 Second steam outlet
21 Connecting line to condenser
22 Condenser, device for refeeding of condensate
23 Cooling-water inlet, cooling-medium inlet
24 Cooling-water outlet, cooling-medium outlet
25 Connecting line for condensate to steam saturator
26 Cooling-water loop, cooling apparatus
27 Condensate return line at steam saturator
28 Steam distributor
29 Holes

What is claimed is:

1. An arrangement comprising:

a steam saturator configured to produce saturated steam, wherein the steam saturator includes:

a steam inlet configured to deliver steam to the steam saturator, a steam outlet for the saturated steam that is produced, and a condensate return line, wherein in a lower region of the steam saturator, the steam saturator is configured to maintain a condensate liquid level that is fluidically connected to the condensate return line; and a condenser configured to refeed liquid evaporated in the steam saturator, wherein the condensate return line is connected to the steam saturator, wherein the condenser comprises a cooling apparatus for condensing steam that is delivered to the condenser;

wherein the condensate return line is fluidically connected to a lower region of the condenser via a connecting line;

wherein the steam saturator is coupled to the condenser via the connecting line in a manner of communicating tubes such that a condensate liquid level in the condenser changes in a corresponding manner when the condensate liquid level in the steam saturator changes.

2. The arrangement of claim 1 wherein the arrangement comprises a connecting line for saturated steam leading from the steam saturator to the condenser, the connecting line being configured to convey saturated steam from the steam saturator into the condenser.

3. The arrangement of claim 2 wherein the connecting line for saturated steam leading from the steam saturator to the condenser leads into the condenser in an upper region of the condenser.

4. The arrangement of claim 1 wherein the steam outlet is a first steam outlet, the steam saturator comprising a second steam outlet that is fluidically connected to the condenser via a connecting line.

5. The arrangement of claim 1 wherein the cooling apparatus of the condenser includes heat-transfer surfaces that are, with a maximum fill level in the steam saturator, configured to be flooded with condensate.

6. The arrangement of claim 5 wherein the heat-transfer surfaces are positioned in the condenser such that the heat-transfer surfaces are partly exposed if a fill level in the steam saturator is too low.

7. The arrangement of claim 1 wherein the condenser includes a housing and is disposed outside of a housing of the steam actuator.

8. The arrangement of claim 1 wherein the condenser is disposed within a housing of the steam saturator.

9. The arrangement of claim 8 wherein a size and a volume of the condenser are less than half of a vessel size and a vessel volume of the steam saturator.

10. The arrangement of claim 1 wherein the cooling apparatus of the condenser includes a cooling-medium inlet and a cooling-medium outlet, wherein the cooling-medium inlet is fed by an externally delivered cooling medium that is not the condensate that accumulates in the steam saturator.

11. The arrangement of claim 1 wherein the steam saturator comprises a horizontal or a vertical pressure vessel, within which pressure vessel a steam distributor is arranged in the lower region below the liquid level.

12. The arrangement of claim 11 wherein the steam distributor is a tube that has holes that are configured to permit steam to exit, the tube being connected at one end region to the steam inlet.

13. A method for operating the arrangement of claim 1, the method comprising:

producing saturated steam in the steam saturator;

delivering superheated steam to the steam saturator, with the superheated steam being introduced via a steam distributor into a condensate liquid volume present in the lower region of the steam saturator;

maintaining the condensate liquid level in the steam saturator such that if the liquid level drops condensate is refed via the condenser, which is connected to the steam saturator; and delivering steam from the steam saturator to the condenser, wherein the steam is condensed in the condenser in a cooling apparatus, the condenser being coupled via a connecting line for condensate to the steam saturator such that if the liquid level in the steam saturator drops a liquid level in the condenser also drops, thereby condensing steam automatically and the condensate being delivered to the steam saturator.

14. The method of claim 13 comprising, with a normal fill level in the steam saturator, flooding heat-transfer surfaces of the cooling apparatus in the condenser with steam condensate.

15. The method of claim 13 wherein, with a fill level below a normal fill level in the steam saturator, heat-transfer surfaces of the cooling apparatus in the condenser are partly exposed, and thereby, steam is condensed in the condenser.

16. The method of claim 13 wherein the steam saturator and the condenser, which serves as a device for refeeding evaporated liquid, are coupled via the connecting line in a manner of communicating tubes such that if the condensate liquid level in the steam saturator changes, a condensate liquid level in the condenser changes in a corresponding manner.

17. The method of claim 16 wherein condensate accumulating in the condenser flows from the condenser into the steam saturator in a pressureless manner and without a separate conveying device.

18. An arrangement comprising:

a steam saturator configured to produce saturated steam, wherein the steam saturator includes:

a steam inlet configured to deliver steam to the steam saturator, a steam outlet for the saturated steam that is produced, and a condensate return line, wherein in a lower region of the steam saturator, the steam saturator is configured to maintain a condensate liquid level that is fluidically connected to the condensate return line; and a condenser configured to refeed liquid evaporated in the steam saturator, wherein the condensate return line is connected to the saturator, wherein the condenser comprises a cooling apparatus for condensing steam that is delivered to the condenser;

wherein the condenser is disposed within a housing of the steam saturator.

* * * * *